US005216909A

United States Patent [19]

Armoogam

[11] Patent Number: 5,216,909

[45] Date of Patent: Jun. 8, 1993

[54] ELECTRO-MECHANICAL LOCKING MECHANISM

[76] Inventor: Michael A. Armoogam, 3720 Mykonos Ct., Boca Raton, Fla. 33487

[21] Appl. No.: 861,577

[22] Filed: Apr. 1, 1992

[51] Int. Cl.[5] ..... E05B 47/06

[52] U.S. Cl. ..... 70/278; 70/283; 292/144; 292/150

[58] Field of Search ..... 70/283, 277, 278, 279; 292/144, 150, 341.16

[56] References Cited

U.S. PATENT DOCUMENTS

| | | | |
|---|---|---|---|
| 2,028,852 | 1/1936 | Vincent | 70/283 |
| 2,031,523 | 2/1936 | Braren | 70/283 |
| 2,105,350 | 1/1938 | Fitzgerald | 292/144 X |
| 2,162,048 | 6/1939 | Askew | 292/144 X |
| 3,158,217 | 11/1964 | Johnson | 292/144 X |
| 3,907,343 | 9/1975 | Goodwin | 292/144 X |
| 4,148,092 | 4/1979 | Martin | 70/283 X |
| 4,634,155 | 1/1987 | Geringer et al. | 292/144 |
| 4,784,415 | 11/1988 | Malaval | 292/144 |

FOREIGN PATENT DOCUMENTS

| | | | |
|---|---|---|---|
| 839865 | 4/1939 | France | 292/144 |
| 308285 | 5/1933 | Italy | 70/283 |
| 10934 | of 1912 | United Kingdom | 292/144 |

*Primary Examiner*—Lloyd A. Gall

[57] ABSTRACT

An electro-mechanical lock includes a selectively operated bolt or latch which, when the bolt or latch is unblocked, may be selectively moved between a lock and an unlock position. A bolt blocking pin, which is float-mounted on a bias spring, is driven, by a first solenoid to a bolt blocking position, when the bolt is in a lock position. A spring biased solenoid pin of a second solenoid, is normally held against the blocking pin by the bias-spring and is driven by the bias-spring, to secure the bolt blocking pin in a bolt or latch locking position when the blocking pin is driven to the latch blocking position by the first solenoid. The spring biased pin is withdrawn from securing the blocking pin in bolt blocking position by energization of the second solenoid. Actuation of the solenoids to drive the bolt blocking pin into the bolt blocking position and to release the bolt blocking pin from a bolt securing position is accomplished by command or code operated switching.

12 Claims, 2 Drawing Sheets

"LOCK" SOL
"UNLOCK" SOL
Q01
Q02
Q03
Q04
R01
R02
R03
R04
R05
R06
R07
R08
R09
R10
R11
R12
R13
R14
R15
R16
R17
R18
R19
R20
R21
R22
C01
C02
C03
C04
C06
C07
C08
C09
D01
D02
Y01
J1
J2
U01
U02
U03
U04
U05
U06
DISP01
TEST
START
BOLT SW
9V
CLR
31
34
36
29
30

ELECTRO-MECHANICAL LOCKING MECHANISM

BACKGROUND OF THE INVENTION

1. Field of the Invention

This invention is directed to an apparatus and to a system. More specifically, this invention concerns an electro-mechanical locking mechanism and to a system for control of such mechanism.

2. Description of the Prior Art

Electro-mechanical locks have and continue to be used in a variety of environments, including the traditional bank-type vaults (security safes); door locks for home and automobile; and security locks for prison cells and other places of confinement.

Generally such locks include a bolt or latching mechanism which can be manually or electrically engaged, a blocking mechanism which prevents the bolt or latch from disengagement (opening); and an electric or electronic means for activation and inactivation of the blocking mechanism. In the context of this discussion, the phrase "blocking mechanism" is intended as descriptive of a mechanical impedance to movement of the bolt or latch which is associated therewith to prevent its inadvertent movement.

The following patents are illustrative of the relevant prior art: U.S. Pat. Nos. 4,686,912; 4,685,709; and 4,982,585.

U.S. Pat. No. 4,686,912 (to Fogleman, et al) describes an electrically controlled latching mechanism which enables a door to be released by either a mechanical combination lock or by an electrical lock control circuit. The Fogleman device is reportedly useful for adaptation to "in-room" hotel or motel safes. In Fogleman, the combined action of electronic locking mechanism and solenoid cause a pair of reciprocating locking bars, located within the vault door, to move or engage a catch within the vault door frame, thereby locking the vault (Column 3, Line 39–46). A key pad is provided to allow the user to input an alpha-numeric code (access code) to cause an electronic circuit to energize the bolt and thereby cause it to retract unlocking the vault door. In the Fogleman patent, the intricacies of solenoid activation are set forth in FIG. 2 thereof. The solenoid activation apparently moves a pivotally mounted lever, causing reciprocal movement of a locking bar mechanically affixed to opposite end of the lever. It would appear that a single solenoid is utilized to lock the vault.

U.S. Pat. No. 4,685,709 (to Kambic) describes a complex locking mechanism for a jail cell door. In brief, the primary locking mechanisms are motor driven, and upon appropriate activation can lock or unlock the jail cell door. Alternatively, a single solenoid can activate and inactivate the same locking mechanism. In the event there is a power failure, when the doors are locked a "fail-safe" feature is provided to return the door lock to the lock position (FIG. 11 and accompanying description at Col. 8, line 23–53). This is achieved by simply providing a biasing spring relative to the solenoid associated with a linkage to power the latch activating mechanism. Upon loss of power, the solenoid is de-energized and the opposing spring activates the latching mechanism, thus locking the cell door.

U.S. Pat. No. 4,982,585 (to Davis, et al) describes a timer for bank vaults for use in conjunction with a pair of solenoids and a mechanical latch for locking of the vault door. In brief, an energizing signal causes one of the two solenoids to release a floating, latching cam (reference numeral 144). The floating latching cam is caused to move in a downward direction by a spring biasing means (reference numeral 142). The relative movement of the floating cam causes the plate (reference numeral 74) to move in the same relative direction, thereby affecting latching (unlatching) of the vault door.

As is evident from the foregoing, electro-mechanical locking mechanisms have become increasingly complex, requiring redundant or back-up systems in the event of failure and are generally ill-adapted for simple and cost effective applications (i.e. hotel rooms and home security environments). Accordingly, there is a continuing need for a simple yet effective design for an electro-mechanical lock which is free from the shortcomings as set forth hereinabove.

OBJECTS OF THE INVENTION

It is the object of this invention to remedy the above as well as related deficiencies in the prior art.

More specifically, it is the principal object of this invention to provide a simple, yet effective, electro-mechanical lock suitable for adaptation to a vault door; and, a system for control thereof.

It is another object of this invention to provide an electro-mechanical lock wherein the bolt or latch is mechanically set and thereafter blocked from opening or retraction by electro-mechanical means.

It is yet another object of this invention to provide an electro-mechanical lock wherein the electro-mechanical means which precludes opening or retraction of the locking mechanism is controlled by a programmable micro-processor.

It is still yet another object of this invention to provide an electro-mechanical lock wherein the programmable micro-processor is used to energize the mechanism for opening or retraction of the latching means has its own internal power supply and thus retentive of access codes and other pertinent instructions to operate the lock, even if power is lost or temporarily interrupted. Additional objects of this invention include methods for control and operation of electro-mechanical locks of this invention.

SUMMARY OF THE INVENTION

The above and related objects are achieved by providing a simple, yet effective, electro-mechanical lock and associated programmable microprocessor for control and operation thereof. The preferred embodiment of the electro-mechanical lock comprises, in its basic or simplest form, a platform or housing, a first (locking) solenoid, a blocking pin, a second (unlocking) solenoid and a bolt or latch which can engage the frame of the vault door and thereby prevent the vault door from being opened. In order to lock the vault door, the bolt or latch is initially set (preferably manually) and the appropriate code entered, thereby energizing the first solenoid. The first solenoid (also hereinafter referred to as the "push" solenoid), causing the blocking pin to move into position relative to the bolt or latch to prevent retraction thereof. The blocking pin is retained in position by the mechanical action of a compressed spring upon the plunger of a second solenoid. The plunger of the second solenoid, at rest, is in contact with, and in sliding engagement with the blocking pin. Upon movement or displacement of the blocking pin by the first solenoid the relative movement of the blocking pin to the piston of the second solenoid follows the contour of the blocking pin as it is urged into blocking position relative to the bolt by the first solenoid, whereupon the plunger of the second solenoid is positioned relative to the top of the pin to prevent the retraction of the pin from its blocking position relative to the bolt or latch. The spring tension upon the piston of the second solenoid exerts sufficient mechanical force such that the piston engages a detent in the blocking pin and thereby retain the blocking pin in position until such time as the piston is retracted.

Upon entry of the proper alpha numeric code, the second solenoid is energized thereby retracting the piston, thus releasing the blocking pin which is returned to its at rest position by the spring associated therewith. The retraction of the blocking pin thus allows movement of the bolt or catch by mechanical or other means. Unlike conventional electro-mechanical locking mechanisms, the relative positioning of solenoids of the locking mechanism provides an effective yet inexpensive means for securing a bolt or latch while achieving such result in a manner which is both effective and amenable to simplified microprocessor control. Another feature which is believed unique to this invention is the requirement of a separate and distinct electrical signal to lock and unlock the bolt or latch. Thus, the electro-mechanical lock cannot be inadvertently locked or unlocked; and is independent of an external power supply for its operation.

DETAILED DESCRIPTION OF THE INVENTION INCLUDING PREFERRED EMBODIMENTS

Figure 2:
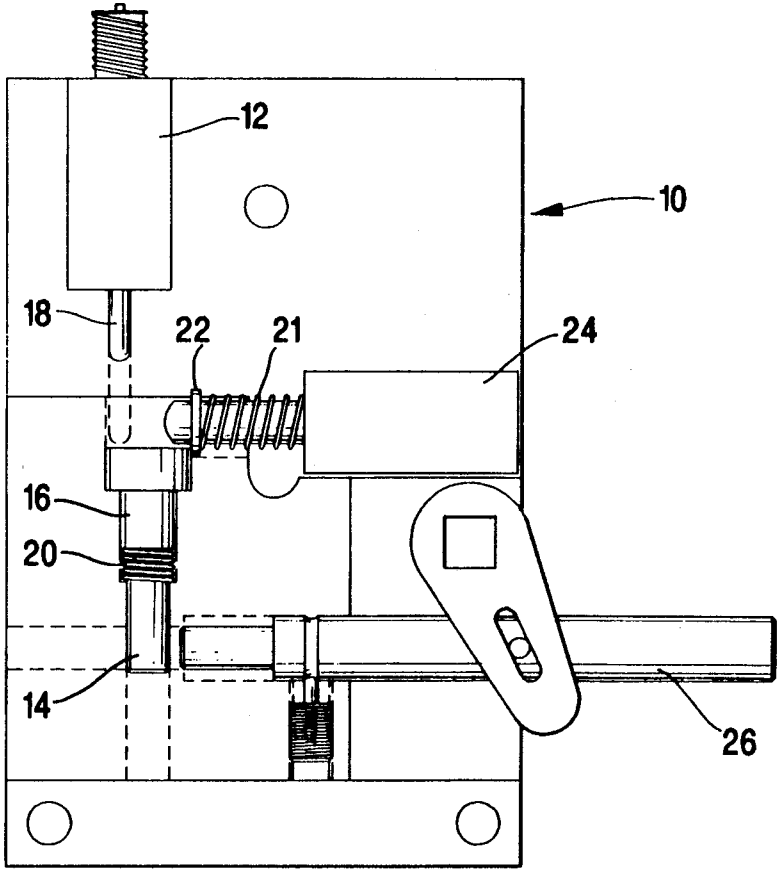
FIG. 2 is a diagramatic illustration of the electro-mechanical lock of this invention depicting the operation thereof in the locked position.

In order to facilitate understanding of the concepts of this invention, reference is hereinafter made to FIGS. 1–3. Where the same element appears in one or more of these Figures, it is assigned a common reference numeral for continuity of description and ease of understanding.

Figure 1:
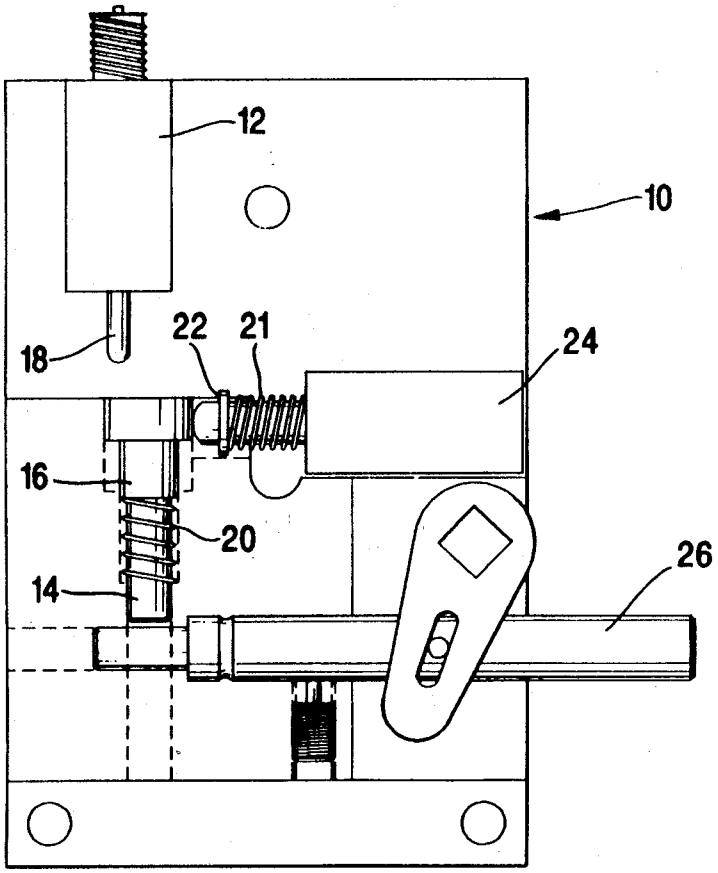
FIG. 1 is a diagramatic illustration of the electro-mechanical lock of this invention depicting the operation thereof in the unlocked position.

FIG. 1 illustrates an electro-mechanical lock (10) having a first or "push" solenoid (12) (also hereinafter "locking solenoid"), a blocking pin (14) float-mounted within a channel (16) allowing for movement of said pin in the same relative direction as the piston (18) of the locking solenoid (12). The blocking pin (14) is further characterized as having a helical spring (20) associated therewith for maintaining the pin in a neutral position; that is non-interfering with the relative reciprocal movement of the bolt or catch (26) as it is manually moved from the locked to the unlocked position and then back again. The blocking pin (14) is adapted for contact and sliding engagement with the piston (22) of the second or "pull" solenoid (24) (also hereinafter "unlocking solenoid") which is positioned at right angles to the direction of travel, and in sliding engagement, to the blocking pin (14).

The depiction of the electro-mechanical locking mechanism as illustrated in FIGS. 1 and 2 is independent of any other environmental structure. More specifically, the locking mechanism depicted in the figures can readily be incorporated into a simple vault door, such as that used in a hotel room or one of a more complex design such as that used in a commercial environment. Alternatively, such design has application in the penal and other security oriented environments. This design has obvious advantages which set it apart from those previously discussed, the least of which being that the position of the blocking pin relative to the bolt or catch is and remains in the same relative position whether or not the power to the device is interrupted. The other advantages inherent in the device include its relative simplicity in operation and manufacture. Insofar as the push solenoid (12) is not placed under any undue physical mechanical stress by virtue of its placement relative to the bolt (26) or catch, it cannot be damaged when pressure is brought to bear on the blocking pin since the integrity and positioning of the blocking pin does not require continual exertion of pressure from either solenoid (12, 24).

The configuration of the device of this invention is also unique in that it requires two separate and distinct electrical pulses to operate (lock or unlock), a first pulse to positively move the blocking pin so as to obstruct reciprocal movement of the bolt (26) or latch (locked position); and, a second pulse to allow retraction of the blocking pin (14) to a neutral position and thereby allow reciprocating movement of the bolt (26) or latch (unlocked position). Accordingly, it is not possible to inadvertently lock the safe or door equipped with the type of device of this invention. This is particularly important when this device is to be used in a commercial setting such as a bank vault or other environment in which an accident of this type could prove potentially dangerous. In less critical environments (a hotel), the requirement of two separate pulses also avoids inadvertent and unnecessary involvement of personnel where the guest may inadvertently lock his possessions in a safe and forget the combination. In the device of the instant invention, the guest enters a personal code of his own choosing, (i.e. his birthday, license plate number or social security number), thus causing the safe to be locked and thereafter can unlock the safe using the same access code information.

This simplification of programming is a distinct advantage and permits the relatively unsupervised use of this device in a consumer oriented environment.

Figure 3:
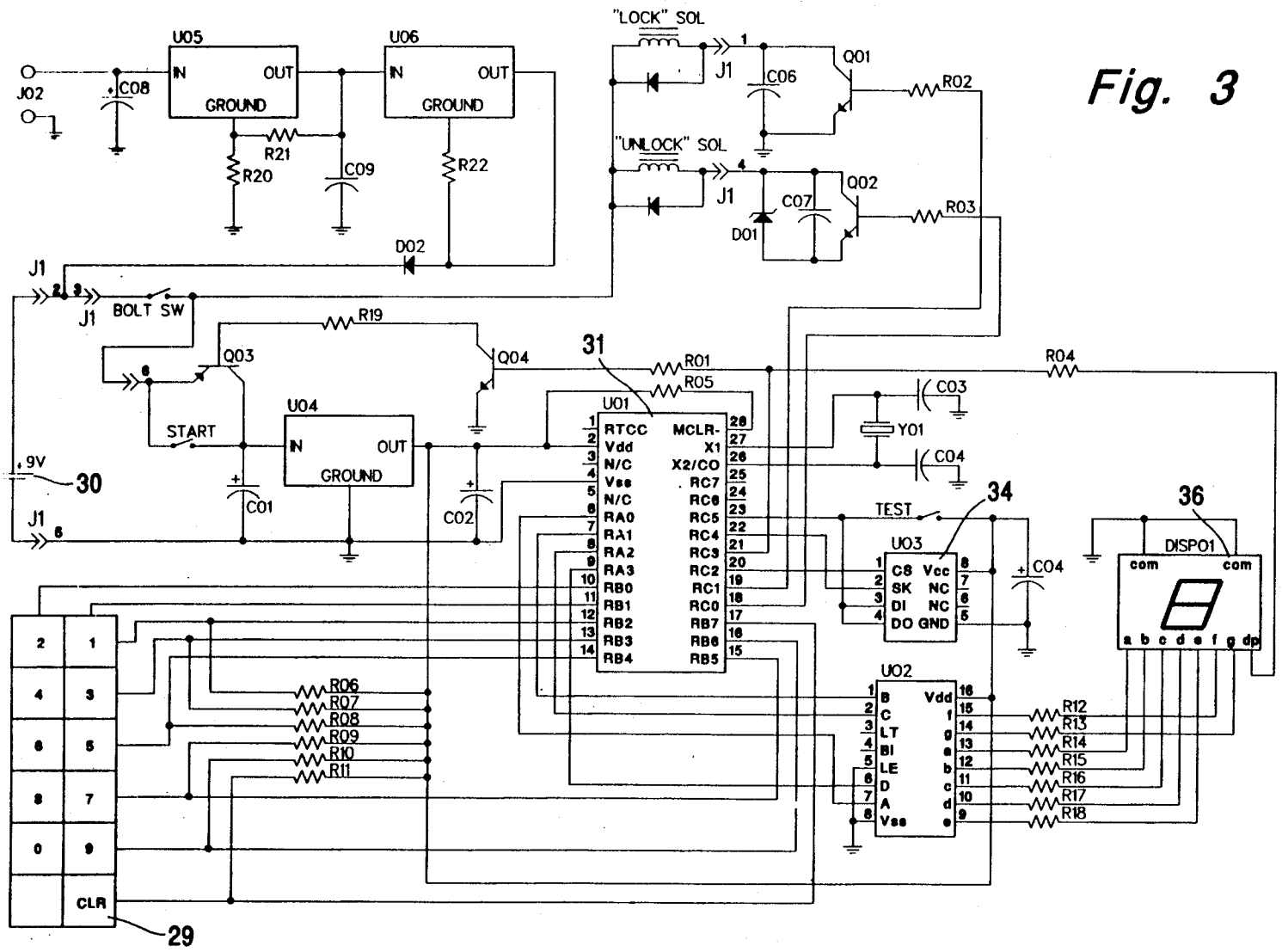
FIG. 3 is a circuit diagram of the electronics used to implement the locking and unlocking of the electro-mechanical lock of FIG. 1.

In FIG. 3 a circuit diagram is provided in which a representative embodiment of the controller circuitry is set forth. In brief, an alpha-numeric pad (30) is provided which permits the user to key in an access code (i.e. combination) into a microcomputer (32). The access code is stored in non volatile memory (34). The access code causes the signalling or triggering of the first solenoid (12) thereby effecting displacement of the blocking pin (14) from its neutral position, relative to the bolt (26) or latch, to one obstructing further reciprocal movement thereof and thus locking the safe door. Conversely, when an individual desires to open the safe he simply re-keys his personalized access code thus causing the second solenoid (24) to retract thereby effecting release of the blocking pin (14) which moves from a blocking to a neutral position relative to the bolt and, thus, permitting reciprocal action of the bolt (26) or latch and the opening of the safe door.

In the preferred embodiments of this invention, the electronic circuitry is provided with its own internal power supply (30) which includes a rechargeable battery connected to a voltage regulator. The voltage regulator provides continuous charging of the rechargeable battery from the house current to which it is connected. The configuration of the electronic components in FIG. 3 contemplates a constant trickle charge being applied to the micro-processor from the rechargeable battery, thus, maintaining the access code in memory even when power is interrupted. Because the solenoids are only intermittently activated, that is at the time of closing and opening the safe, there is no constant drain upon the power supply and thus the batteries should last almost indefinitely. More specifically, the period between locking and unlocking the same does not require any power to be maintained to the solenoids nor does it require any substantial drain from any other components of the system.

The preferred embodiment of this invention, as alluded to above, contemplates an energy saving feature which can be critical to the effective use of the invention in a residential or hotel safe environment. The preferred embodiments of this invention incorporate a battery either as a primary source of power or a back-up to an external power supply. The microprocessor which is used in this invention has, in non-volatile memory, coded information indicative of a numerical combination through which the operator is permitted to both lock and unlock the system. In practice, a bolt (26) or catch is mechanically placed in the locked position (FIG. 2). Such placement energizes a switch which permits power to flow to the microprocessor and the electronic circuitry associated therewith.

At the outset, it is assumed that there is no combination stored within the memory circuits of the microprocessor and one is initially encoded by simply touching a sequence of numbers on a key pad (29). This number sequence is then displayed (36) to allow the user to confirm and record the number sequence. Where the sequence is as desired, the user simply touches an additional key which places such sequence within the microprocessor memory (34). Where an individual desires to utilize the safe, the safe door is opened, the valuables placed within and the door closed. The lock (26) or bolt is manually set, thereby re-energizing the circuitry and the electronic control associated therewith. Upon reentry of the appropriate code, an energizing signal is sent to the first, or push, solenoid (12) thereby causing a blocking pin (14) to be displaced from a neutral position into blocking relationship relative to the reciprocal movement of the latch or bolt. With the placement of the blocking pin by the first solenoid in blocking position, it is retained in such position by mechanical (spring) means (21) associated with the plunger (22) of the second solenoid (24). Subsequent to a brief period following energization of the first solenoid, the power to the system is once again shut off. The first solenoid (12) is, thus, inactivated and its plunger (18) withdrawn from contact with the blocking pin to a neutral position. Thus, when the safe is locked no power drain occurs upon its internal power supply and thus the electronic circuitry, except for a trickle charge to the memory circuit, is essentially inactive. When the user desires to open the safe, he simply re-enters the appropriate personal access code, which activates the flow of electrical power to the microprocessor and the electronic circuitry associated therewith. With this entry of the appropriate person access code on the key pad (30), the microprocessor energizes a second, or pull, solenoid (24) thereby causing its plunger (22) to retract, removing the restraint upon movement of the pin (14). The mechanical (spring) means (20) associated with the pin (14) caused it to withdraw to a neutral position thereby allowing for reciprocal movement of the latch or bolt (26). This process can be repeated one or more times to allow for repeated access or locking of the safe.

The foregoing description of the preferred embodiments of this invention is intended as illustrative of the manner in which the concept can be practiced, however not intended to delineate its scope which is set forth in the claims which follow.

What is claimed is:

1. In an electro-mechanical lock being adjustable from an unlock condition to a lock condition and held in said lock condition by a mechanical means with additional mechanical means for retaining said electro-mechanical lock in said lock condition and against unauthorized adjustment of said electro-mechanical lock to said unlock condition, said electro-mechanical lock comprising:

a) a bolt, selectively adjustable to a lock position from an unlock position when desired and selectively adjustable to said unlock position from said lock position when released;

b) a floating blocking pin having a first position for holding and retaining said bolt in said lock position and having a second position for releasing said bolt for selective adjustment of said bolt between said lock position and said unlock position;

c) a first solenoid having a first pin for making contact with said floating blocking pin when said first solenoid is energized for driving said floating blocking pin to said first position for holding said bolt in said lock position when said bolt is adjusted to said lock position; and d) a second solenoid having a second pin for making contact with said floating blocking pin, said second pin including a first bias means for driving said second pin over said floating blocking pin for retaining said floating blocking pin in said first position when said bolt is in said lock position and said floating blocking pin is in said first position, said second solenoid for removing said second pin from over said floating blocking pin, when energized, for permitting said floating blocking pin to return to said second position.

2. In an electro-mechanical lock as in claim 1 and said electro-mechanical lock further includes a power supply means for providing power for energizing said first solenoid and a switch means, positioned between said power supply and said first solenoid, said switch means for actuating said first solenoid in response to a command.

3. In an electro-mechanical lock as in claim 2 and in which said switch means includes a code means and said command includes a first code entered into said code means.

4. In an electro-mechanical lock as in claim 1 and in which said floating blocking pin further includes a second biasing means for returning said floating blocking pin to said second position for releasing said bolt when said second pin is removed from over said floating blocking pin.

5. In an electro-mechanical lock as in claim 1 and including a power supply means for energizing said first solenoid and in which said floating blocking pin is driven to said first position by said first pin when said first solenoid is energized by said power supply means.

6. In an electro-mechanical lock as in claim 5 and in which said first solenoid further includes a third biasing means for returning and holding said first pin to a neutral position, out of contact with said floating blocking pin, when said first solenoid is deenergized.

7. In an electro-mechanical lock as in claim 2 and in which said switch means includes a code means and said switch means is operated in response to a predetermined code entered into said code means.

8. In an electro-mechanical lock being selectively adjustable from an unlock condition to a lock condition and held in said lock condition by a mechanical means and against unauthorized adjustment of said electro-mechanical lock from said lock condition to said unlock condition, said electro-mechanical lock comprising:

a) a bolt means being freely adjustable from an unlock position to a lock position and adjustable from said lock position to said unlock position in response to a first predetermined command;

b) a bolt blocking pin float-mounted in a chamber on a first biasing means, said bolt blocking pin being movable in said chamber from a bolt release position to a bolt block position against said first biasing means for blocking said bolt means from adjustment of said bolt means from said lock position to said unlock position;

c) a first solenoid including a first pin, said first pin for driving said bolt blocking pin against said first biasing means, from said bolt release position to said bolt block position in response to a second predetermined command; and d) a second solenoid including a second pin, said second pin having a first position when said bolt blocking pin is in said bolt release position and having a second position when said bolt blocking pin is in said bolt block position, said second position for securing said bolt blocking pin in said bolt block position, said second solenoid for driving said second pin to a third position when said second solenoid is energized, said third position for releasing said bolt blocking pin for permitting said first biasing means to move said bolt blocking pin in said chamber from said bolt block position to said bolt release position.

9. An electro-mechanical lock as in claim 8 and in which said second solenoid further includes a second biasing means for driving said second pin from said first position to said second position for securing said bolt blocking pin in said bolt block position.

10. An electro-mechanical lock as in claim 8 and further including a power supply means for energizing said first solenoid and said second solenoid and a switch means between said power supply means and said first solenoid for energizing said first solenoid in response to said second predetermined command.

11. In an electro-mechanical lock as in claim 10 and in which said switch means is between said power supply means and said second solenoid for energizing said second solenoid in response to said first predetermined command.

12. An electro-mechanical lock as in claim 10 and in which said switch means includes a code means and said first predetermined command includes a first code entered into said code means and said second predetermined command includes a second code entered into said code means.

* * * * *